United States Patent [19]

Nitzberg

[11] 4,422,620

[45] Dec. 27, 1983

[54] ADJUSTABLE FULCRUM HAMMER

[76] Inventor: Jerold I. Nitzberg, 3029 Fleetwood Ave., Baltimore, Md. 21214

[21] Appl. No.: 365,866

[22] Filed: Apr. 5, 1982

Related U.S. Application Data

[63] Continuation-in-part of Ser. No. 238,956, Feb. 27, 1981, abandoned.

[51] Int. Cl.[3] ..... B25C 11/00

[52] U.S. Cl. ..... 254/26 E

[58] Field of Search ..... 254/26 E, 26 R, 27; 145/29 R

[56] References Cited

U.S. PATENT DOCUMENTS

| | | | |
|---|---|---|---|
| 145,992 | 12/1873 | Dillon | 254/26 R |
| 540,967 | 6/1895 | Eveleth | 254/26 E |
| 587,242 | 7/1897 | Shepard | 254/26 E |
| 619,325 | 2/1899 | Martin | 254/26 E |
| 1,226,413 | 5/1917 | Thompson | 254/26 E |
| 1,508,395 | 9/1924 | Isham | 145/29 R |
| 2,589,046 | 3/1952 | Brown et al. | 254/26 E |
| 2,589,047 | 3/1952 | Brown et al. | 254/26 E |

FOREIGN PATENT DOCUMENTS

| | | | |
|---|---|---|---|
| 1336017 | 7/1963 | France | 254/26 E |

*Primary Examiner*—Frederick R. Schmidt
*Assistant Examiner*—J. T. Zatarga
*Attorney, Agent, or Firm*—Cushman, Darby & Cushman

[57] ABSTRACT

An adjustable fulcrum hammer with a handle having a grip at one end, a head fixed about the other end, a fulcrum rod extending into the hollow interior of the handle through a bore in the head, an elastomeric member on the end of the rod remote from the head for contacting a fulcrum surface, a set screw extending the handle between its ends for locking the fulcrum rod in any desired position and a spring mounted within the handle for urging the rod outward. In another embodiment of the present invention, a locking mechanism is integrally provided by cooperating threads which disengage and allow for reciprocable movement when the fulcrum member is rotated a quarter-turn.

6 Claims, 6 Drawing Figures

ADJUSTABLE FULCRUM HAMMER

RELATED APPLICATIONS

This is a continuation-in-part of U.S. patent application Ser. No. 238,956, filed Feb. 27, 1981, now abandoned.

BACKGROUND AND SUMMARY OF THE INVENTION

The present invention relates to an improved adjustable fulcrum hammer.

Conventional hammers are made with a handle extending between a grip at one end and a head having a claw and striking surface affixed to the other end. The claw is typically used for prying, particularly removing nails and the like. The upper surface of the head between the claw and striking surface normally serves as the fulcrum.

One of the drawbacks of such conventional hammers is that the distance between the upper surface of the head which serves as the fulcrum and the point at which the claw grasps a nail or the like to be pried often is not sufficient to completely remove the nail. When prying other objects bending and damage to the object being pried may result if the distance is not sufficient. On the other hand, providing a claw which extends a considerable distance from the handle makes the tool awkward to use and even dangerous.

To overcome this problem, adjustable fulcrum hammers have been developed. These hammers all include some kind of member which slides into and out of the handle between the striking surface and the claw to provide a fulcrum which can be adjusted along the direction of the handle as necessary. Although a number of different configurations have been suggested, none have proven completely satisfactory in use or suffered other drawbacks which have precluded their commercial acceptability.

For example, the patent to Eveleth U.S. Pat. No. 540,967 describes a hammer of this type in which a plunger is provided with a plurality of notches which can be selectively engaged by means of a finger operated latch having a portion extending through the handle between its ends. A cushion is provided on the far end of the plunger for minimizing damage to the surface which is contacted and which thus serves as the fulcrum. A spring attaches to the other end of the plunger urging it outward.

This type of adjustable fulcrum hammer has a considerable number of disadvantages. First, the plunger is difficult to manufacture and cannot be obtained as a standard part. The notches weaken the plunger and provide places where it can easily break as well as interrupt spacing. The plunger must be kept in an orientation where the latch will mesh with one of the notches, thus complicating the internal construction of the handle. The notches will wear and eventually the plunger will not be able to lock firmly in position. Finally, while using this configuration of parts, if the latch is accidentally struck during rebounding off the strike surface the fulcrum will prematurely eject. Other adjustable hammers of interest are described in the patents to Martin U.S. Pat. No. 619,325, Palmer U.S. Pat. No. 856,097, Williams U.S. Pat. No. 2,741,456, Thayer U.S. Pat. No. 35,715, Frey U.S. Pat. No. 107,729, Carlson U.S. Pat. No. 1,737,958, Balkus, Jr. U.S. Pat. No. 3,885,772, and Thomson U.S. Pat. No. 1,226,413.

The present invention relates to an improved fulcrum handle of the type generally described above. However, in the present invention, a fulcrum rod which is preferably in one embodiment a solid cylindrical rod is mounted to be fully rotatable within the interior space in the handle and extending through a bore in the hammer head to the upper surface thereof. A set screw in this embodiment preferably provided with a lock washer is used to lock the rod in any desired position. The set screw provides a lock washer positioned between the hammer handle and the set screw head so as to provide a locking arrangement of the fulcrum member and set screw so as not to vibrate loose and prematurely eject. Since the rod can be rotated within the bore, and since the set screw can contact any position difficulties of wear, weak points are avoided. No complex construction for the fulcrum member or the interior of the handle is required. The present invention can be easily and economically constructed from simple, readily available parts.

According to one embodiment of the present invention, a claw hammer head is fixed about a handle having a grip at one end with the head fixed about the other end. The fulcrum rod extends through a bore into the interior space within the handle which handle is preferably formed as a hollow cylinder. A set screw extends through the handle between the ends thereof, preferably in a built up region having thicker walls for contacting and locking the rod in any desired position. The fulcrum member at the end of the rod remote from the handle is formed of elastomeric material such as rubber or the like so as to avoid marring the surface which it contacts. The fulcrum member at the end of the rod housed within the handle is provided with a bore which allows the urging spring to engage with the fulcrum member end so that the fulcrum member will not completely eject out of the head of the hammer.

According to another embodiment of the present invention, a fulcrum rod is provided with a tap-like configuration and includes opposing planar portions and opposing threaded portions extending down the fulcrum member's length or at least a predetermined portion thereof. A die region within the interior of the hammerhead is provided with the same opposing planar portions and opposing threaded portions configuration as provided with the fulcrum rod so as to engagingly cooperate therewith. The cooperation between the opposing planar and threaded portions of the fulcrum member and die acts as the locking and adjusting means of the fulcrum member in a manner that will become more clear from the description thereof below. A spacing washer or sleeve is provided in the interior space in the handle and contacts that portion of the fulcrum member housed therein. This interior spacing washer prevents the interior portion of the fulcrum member from wobbling as well as preventing free rotation of the fulcrum member in its locked position during normal use of the hammer.

BRIEF DESCRIPTION OF THE DRAWINGS

Other objects and purposes of the invention will become more clear from the following description of the drawings, in which:

FIG. 5 shows a top view of the embodiment shown in FIG. 4 along line 5—5 therein.

DETAILED DESCRIPTION OF THE DRAWINGS

Figure 1:
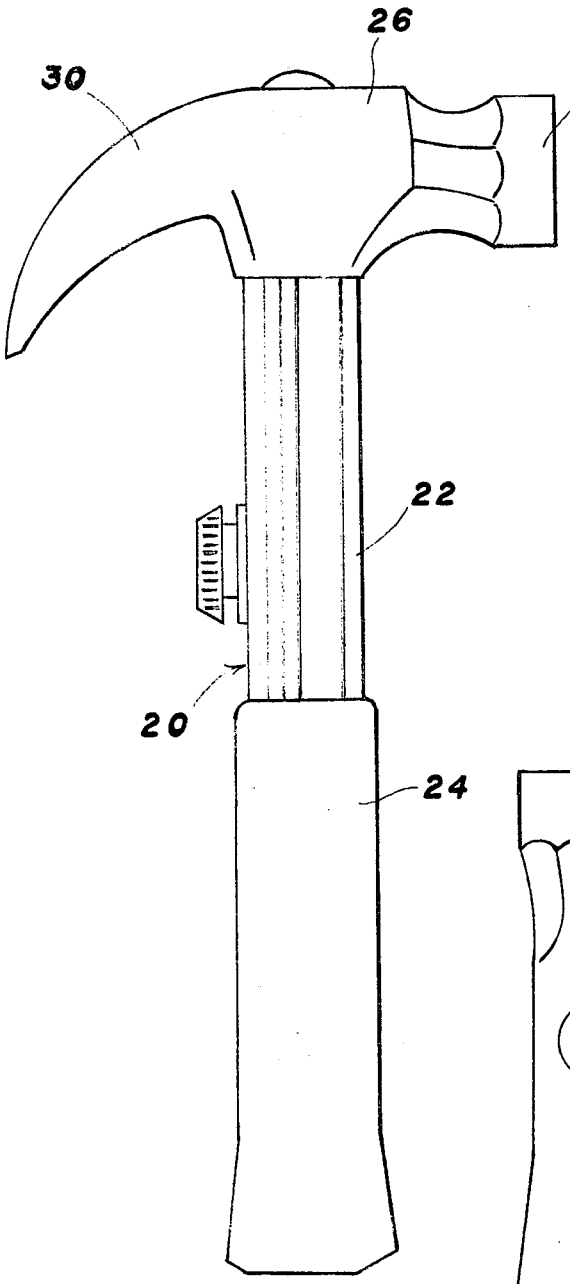
FIG. 1 shows a side view of one embodiment of the adjustable fulcrum hammer of the present invention.
Figure 3:
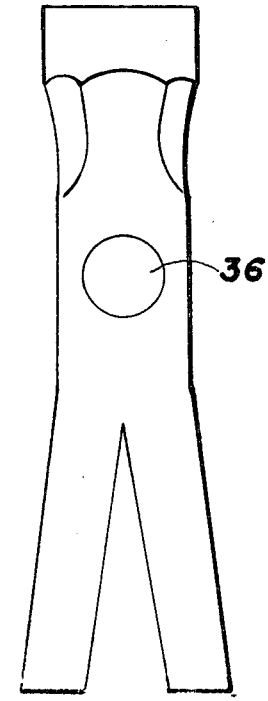
FIG. 3 shows a top view of the present invention.
Figure 2:
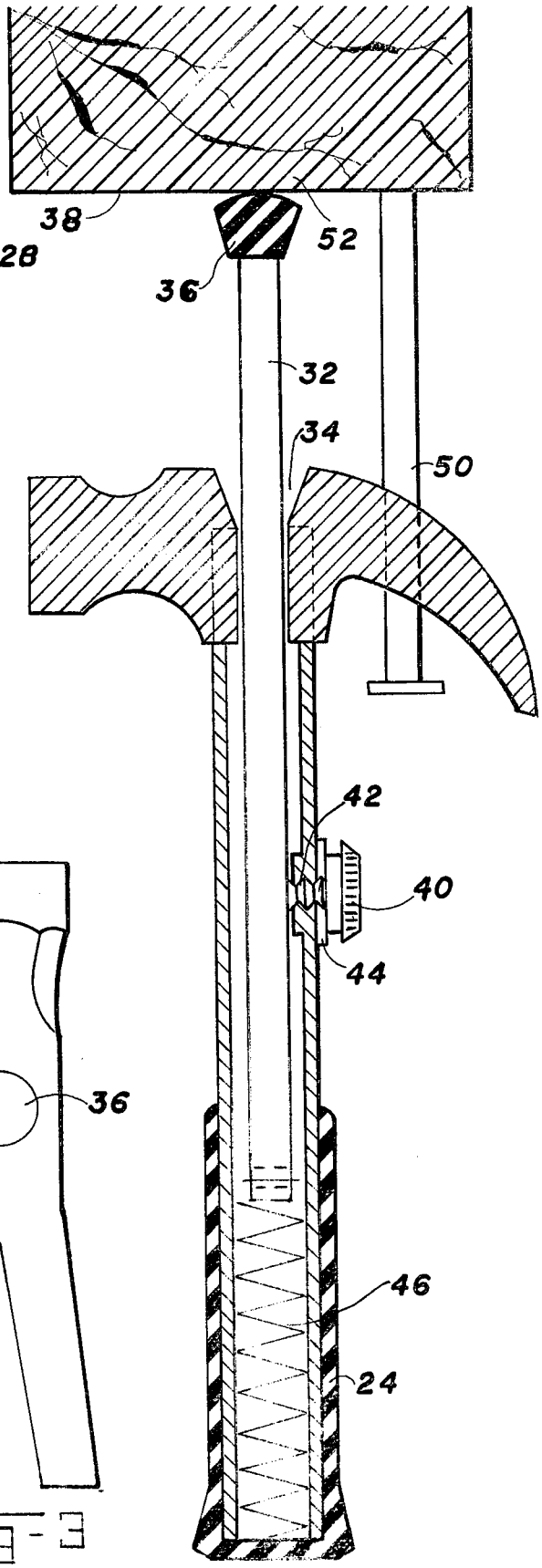
FIG. 2 shows a sectional view of the hammer of the present invention in use, pulling a nail.

Reference is now made to FIGS. 1–3 which illustrate a first embodiment of the present invention. Hammer 20 is formed of a handle 22, preferably in the form of a readily available hollow cylinder, for example, of metal, plastic or other suitable material. A conventional grip 24 extends about one end of handle 22 for manually grasping hammer 20. Claw hammer head 26 is fixed to the other end of handle 22 for example, by friction or otherwise, and includes a conventional striking surface 28 and conventional claw 30. Solid metal fulcrum rod 32 extends through a bore 34 in head 26 serving as a guideway for rod 32 into the hollow interior space within handle 22. An elastomeric member 36 is fixed at the end of rod 32 remote from head 26 for contacting a surface 38 without marring the same. Conventional set screw 40 extends through a threaded bore 42 in a built-up cylindrical portion 44 of handle 22 to contact rod 32 and lock it in any desired position. Locking washer 44 is preferably provided between the head of set screw 40 which is manually rotated and handle 22. Conventional spring 46 is connected at one end to rod 32 as shown and fixed to handle 22 at the other for urging rod 32 in an outward direction. Since spring 46 is fixed to rod 32, however, the rod cannot be removed entirely from the interior of handle 22.

In FIG. 2, the hammer of the present invention is shown in use removing a long nail 50 from a wooden board 52 with member 36 serving as the fulcrum for that use.

Figures 4, 6:
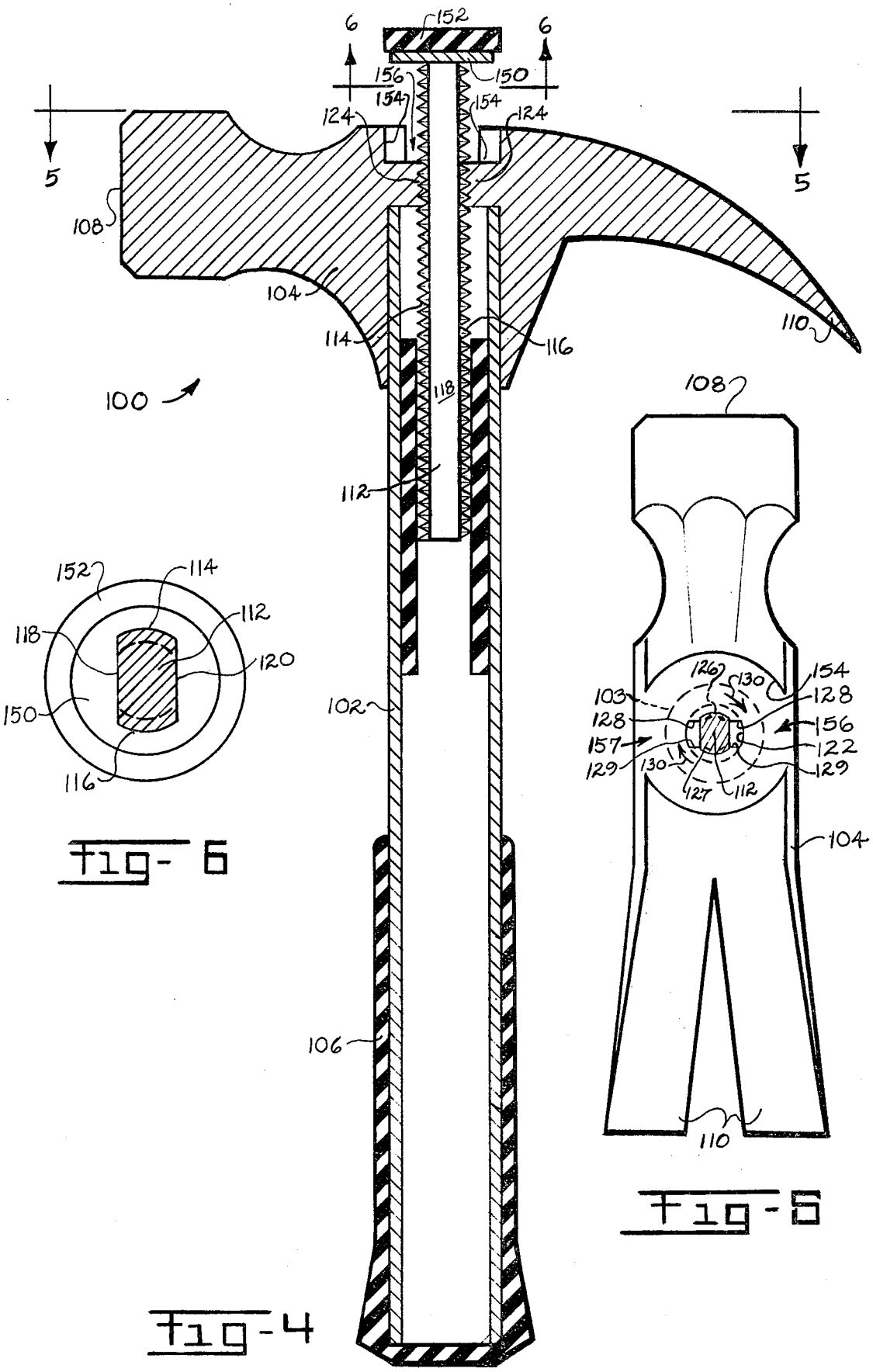
FIG. 4 shows a cross-sectional side view of another embodiment according to the present invention showing the fulcrum member in a partially extended locked position.
FIG. 6 is a detail view of the fulcrum end taken along line 6—6 in FIG. 4.

Reference will now be made to FIGS. 4–6 which illustrate another embodiment of the present invention. Hammer 100 is formed of a handle 102, preferably in the form of a readily available hollow member defining an interior cavity 103, for example, of metal, plastic or other suitable materials, and a claw hammer head 104. A conventional grip 106 extends around handle 102 for manually grasping hammer 100 during use. Claw hammer head 104 is rigidly fixed to one end of handle 102 by suitable friction means, for example, and includes a striking face 108 and conventional claw 110.

A solid metal fulcrum rod 112 is provided with opposing threaded portions 114, 116, respectively, and opposing planar portions 118, 120, respectively, extending substantially along the entire length of rod 112.

The fulcrum rod 112 cooperates with a bore 122 which may be countersunk in the hammer head 104 as shown in FIG. 4 which extends within the interior of the hammer 100 a predetermined dimension serving as a guide passageway. A locking die 124 serves as the locking means of the fulcrum rod 112 and is provided with opposing threaded portions 126, 127 and opposing planar portions 128 on either side of threaded portions 126, 127 with bore 122. The opposing threaded portions 126 in bore 122 within the hammer 100 may be provided with a "flex lock" or "self-lock" mechanism securely cooperating with the threaded portions 114, 116 of fulcrum member 112. This locking means will resist any tendencies of the fulcrum rod 112 from rotating freely within the interior cavity 103 of the handle 102.

Bore 122 is sized so that when fulcrum member 112 is in an unlocked position, it will easily and reciprocably slide therethrough. Fulcrum member 112 may be moved from a locked to an unlocked position by merely rotating it a quarter turn (noted by arrows 130 in FIG. 5) thereby disengaging cooperating threaded portions 114, 126 and 116, 127, respectively. In such an unlocked position, fulcrum member 112 will then be free to be slidably and reciprocably moved to the next predetermined position. When such a position is reached, a quarter-turn of fulcrum member 12 will once again engage threaded portions 114, 126 and 116, 127, respectively, thereby locking it securely in place.

A spacing washer 140 of either metal or elastomeric material is provided in cavity 103 to be maintained around that portion of fulcrum member 112 therein so as to prevent any wobble of fulcrum member 112 and to prevent free rotation thereof so that independent undesirable disengagement of the fulcrum member 112 will not occur during use.

At the exterior end of the fulcrum member 112, a flange 150 is provided and is preferably covered with a predetermined thickness of an elastomeric material 152 to prevent marring of the surface being worked and to provide cushioned leverage for the hammer 100. Preferably in the retracted positon, this elastomeric material 152 covers flange 150 so that it is even with the top surface of the hammer head 102 so as not to interfere with the hammer's conventional use, e.g., use without the fulcrum rod extended. In order to accomplish this flush cooperation, a recess 154 is provided in the top of hammer head 102 and is sized to closely accept flange 150 and the elastomeric material 152 therein when fulcrum member 112 is in a completely retracted position. Also, it should be particularly noted that recess 154 is preferably provided with opposing open side portions 156, 157 so that when fulcrum member 112 is in a completely retracted position, the user may still grasp a portion of flange 150 and elastomeric material 152 so as to rotate fulcrum member 112 and extend it from its retracted position.

Many changes and modifications in the above described embodiment can, of course, be carried out without departing from the scope of the present invention, that scope intended to be limited only by the scope of the appended claims.

What is claimed is:

1. An adjustable fulcrum hammer comprising in combination:

a handle having a grip at one end for manually grasping said handle and an interior cavity extending into said handle from the opposing end;

a claw hammer head having a striking surface and claw and rigidly fixed about said other end of said handle with said striking surface and said claw extending outwardly from said handle, said head having a bore extending therethrough from the upper surface and axially communicating with said cavity;

an elongated fulcrum rod extending through said bore and into at least a portion of said cavity having a flange member rigidly fixed to one end thereof and being capable of turning movement between locked and unlocked positions; and means for reciprocably adjusting the position of said rod between extended and retracted positions relative to said head and for locking said rod in predetermined positions, said adjusting and locking means including a pair of opposing first threaded portions associated with said bore and a pair of second opposing threaded portions associated with said rod, said rod further including a pair of opposing parallel planar surfaces extending along the length of said rod thereby defining together with said first threaded portions the perimeter of said rod, said bore further including means defining surfaces which together with said second threaded portions define an aperture with which said rod perimeter slidably cooperates in said unlocked position so as to permit reciprocal movement of said rod between said extended and retracted positions thereof, said first and second threaded portions matingly engaging one another so as to securely lock said rod relative to said head when said rod is turned from said unlocked position to said locked position.

2. A hammer as in claim 1 wherein said head further includes recess means defining recessed surfaces in the top of said head axially disposed with said bore and said cavity so as to accept said flange member therein when said rod is in said retracted position.

3. A hammer as in claim 2 wherein said recess means defines open side portions to permit a user to grasp a portion of said flange in said retracted position.

4. A hammer as in claim 3 wherein said flange includes an upper covering of an elastomeric material.

5. A hammer as in claim 2, 3 or 4 wherein the top surface of said flange is flush with the top surface of said head when said rod is in said retracted position.

6. A hammer as in claim 1, 2 or 3 further comprising elastomeric sleeve means disposed in said cavity for preventing undesired movement of said rod during operation.

* * * * *

UNITED STATES PATENT AND TRADEMARK OFFICE

CERTIFICATE OF CORRECTION

PATENT NO. : 4,422,620

DATED : December 27, 1983

INVENTOR(S) : Jerold I. NITZBERG

It is certified that error appears in the above-identified patent and that said Letters Patent is hereby corrected as shown below:

Column 3, line 66, after "128" insert --, 129--; and line 67, after "126" insert --, 127--.

Column 4, line 16, change "12" to --112--; and line 33, change "102" to --104--.

IN DRAWING FIGURE 4:

Numeral 140 should reference the elastomeric member disposed between handle 102 and fulcrum rod 112; and Numeral 130 should reference the interior cavity defined by handle 102.

Signed and Sealed this

*Twelfth* Day of *June 1984*

[SEAL]

*Attest:*

GERALD J. MOSSINGHOFF

*Attesting Officer*

*Commissioner of Patents and Trademarks*